US005878501A

United States Patent [19]

Owens et al.

[11] Patent Number: 5,878,501

[45] Date of Patent: Mar. 9, 1999

[54] UTILITY KNIFE WITH RETRACTABLE BLADE GUARD

[75] Inventors: Robert L. Owens, Marion, Conn.; Christopher J. Pigeon, Bennington, Vt.; Timothy O. Van Leeuwen, Brookfield, Conn.

[73] Assignee: The Stanley Works, New Britain, Conn.

[21] Appl. No.: 907,688

[22] Filed: Aug. 8, 1997

[51] Int. Cl.[6] ..... B26B 29/00

[52] U.S. Cl. ..... 30/286; 30/330

[58] Field of Search ..... 30/286, 329, 330, 30/2, 143, 331

[56] References Cited

U.S. PATENT DOCUMENTS

| | | | |
|---|---|---|---|
| 2,025,305 | 12/1935 | Parzer | 30/286 |
| 2,325,485 | 7/1943 | Denny | 30/330 |
| 2,333,743 | 11/1943 | Sampson | 30/330 |
| 2,463,682 | 3/1949 | Doniger | 30/331 |
| 2,644,230 | 7/1953 | Anderson | 30/2 |
| 2,743,523 | 5/1956 | Honey | 30/286 |
| 2,784,498 | 3/1957 | Reise . | |
| 2,867,901 | 1/1959 | Warnes . | |
| 3,906,625 | 9/1975 | Gringer | 30/331 |
| 3,943,627 | 3/1976 | Stanley, Jr. . | |
| 4,005,525 | 2/1977 | Gringer | 30/331 |
| 4,086,698 | 5/1978 | Sparks . | |
| 4,091,537 | 5/1978 | Stevenson, Jr. . | |
| 4,240,202 | 12/1980 | Gilbert | 30/331 |
| 4,242,795 | 1/1981 | Rollband et al. . | |
| 4,586,256 | 5/1986 | Weimann . | |
| 4,713,885 | 12/1987 | Keklak et al. | 30/2 |
| 4,757,612 | 7/1988 | Peyrot . | |
| 4,920,645 | 5/1990 | Baudouin . | |
| 4,949,458 | 8/1990 | Davis et al. . | |
| 5,071,426 | 12/1991 | Dolgin et al. . | |
| 5,139,507 | 8/1992 | Dolgin et al. . | |
| 5,207,696 | 5/1993 | Matwijcow . | |
| 5,250,063 | 10/1993 | Abidin et al. . | |
| 5,275,606 | 1/1994 | Abidin et al. . | |
| 5,330,492 | 7/1994 | Haugen . | |
| 5,414,933 | 5/1995 | Garner . | |
| 5,497,554 | 3/1996 | Hamlin | 30/330 |
| 5,613,300 | 3/1997 | Schmidt | 30/2 |

*Primary Examiner*—M. Rachuba
*Attorney, Agent, or Firm*—Pepe & Hazard LLP

[57] ABSTRACT

A fixed blade utility knife has a housing provided by a lower handle portion, an upper lever portion, and a nosepiece at one end thereof which seats one end of the handle and lever. The lever is pivotably supported on the nosepiece, and a blade holder in the nosepiece is pivotably supported on the handle. The blade is seated in the holder and extends outwardly of the nosepiece, and a blade guard of generally U-shaped cross section extends about the cutting edge and is slidable in the nosepiece to extend outwardly to sheathe the cutting edge and to be withdrawn into the nosepiece to expose the cutting edge. A manipulatable element slidably seated in the nosepiece is engaged with the blade guard to effect its sliding movement. Pivoting of the lever into an open position releases the blade from engagement in the holder so that it may be easily replaced.

16 Claims, 9 Drawing Sheets

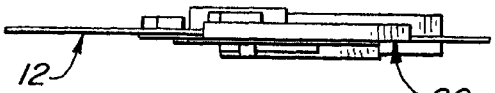
FIG. 29
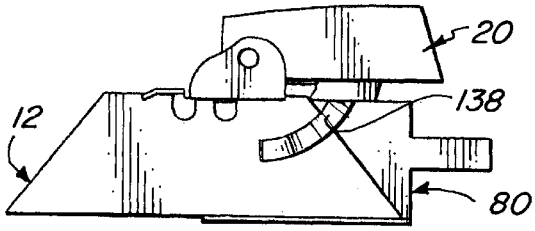
FIG. 27
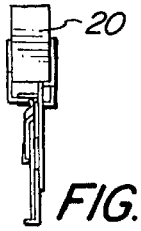
FIG. 28
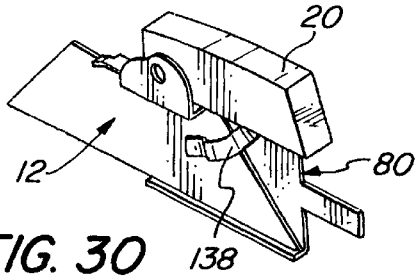
FIG. 30
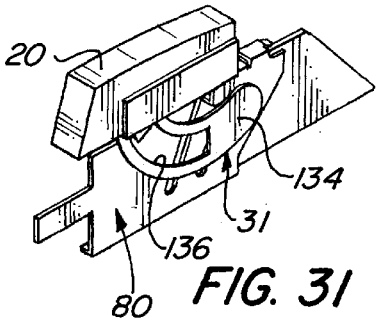
FIG. 31
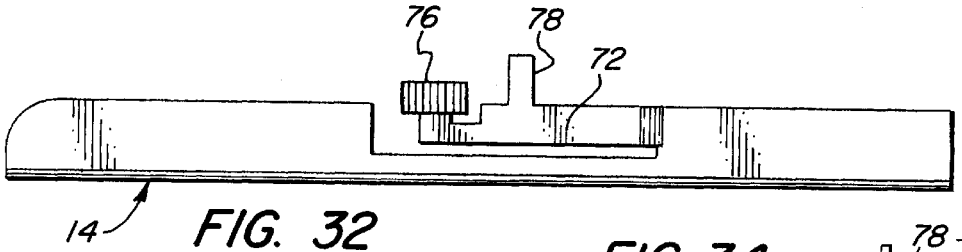
FIG. 32
FIG. 34
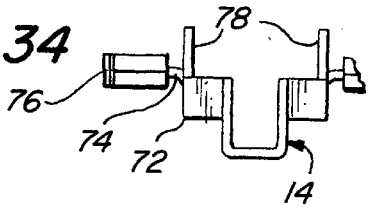
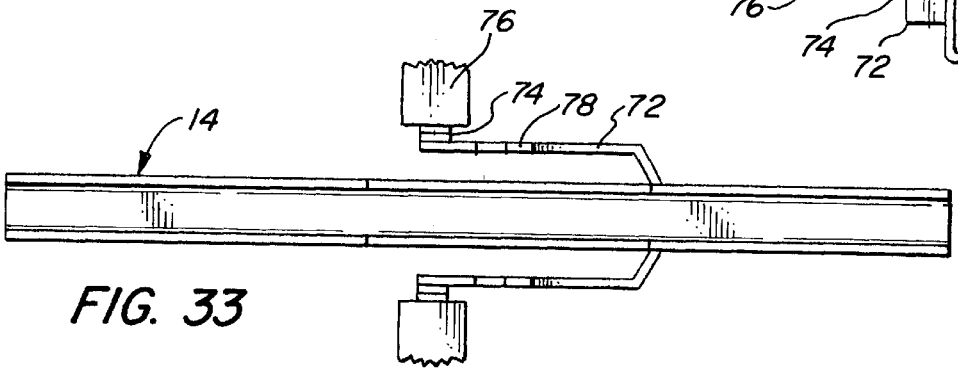
FIG. 33

UTILITY KNIFE WITH RETRACTABLE BLADE GUARD

BACKGROUND OF THE INVENTION

The present invention relates to utility knives and, more particularly, to utility knives having a fixed blade and a guard for the blade edge.

Utility knives are widely employed by homeowners and craftsmen alike for many applications in which it is necessary to cut or score workpieces, as well as for other simple cutting and shaping applications.

Most utility knives have a blade which is moved from a position within the housing or handle to a position extending outwardly therefrom, and that position may be adjustable. Exemplary of such utility knives are those shown in Rollband et al U.S. Pat. No. 4,242,795 granted Jan. 6, 1981 and Weimann U.S. Pat. No. 4,586,256 granted May 6, 1986. Utility knives with fixed blades and movable covers or guards are also known as, for example, those shown in Peyrot U.S. Pat. No. 4,757,612, and one is Warnes U.S. Pat. No. 2,867,901 granted Jan. 14, 1958.

A problem frequently encountered with respect to such utility knives is the safe and facile changing of the blades which rapidly dull or break. Frequently, the mechanism employed to hold the blade securely requires substantial manipulation in order to remove the blade from the carrier or holder and this can present a potential hazard to those utilizing the knife.

It is an object of the present invention to provide a novel utility knife with a fixed blade and a retractable guard for the blade edge.

It is also an object to provide such a utility knife in which the blade may be easily released from the blade holding mechanism by simple manipulation and a new blade readily inserted.

Another object is to provide such a utility knife which is simple to fabricate and assemble and which will provide reasonably long life.

A further object is to provide such a utility knife which is attractive in appearance, easy to use and comfortable to grip.

SUMMARY OF THE INVENTION

It has now been found that the foregoing and related objects may be readily attained in a fixed blade utility knife comprising a housing providing an internal cavity and including a handle providing the lower portion thereof, a lever providing the upper portion thereof and a nosepiece at one end thereof seating one end of the handle and lever. The lever has its one end pivotably supported on the nosepiece for pivotal movement relative to the handle between a closed position abutting the handle and an open position extending substantially perpendicularly to the longitudinal axis of the nosepiece. The nosepiece provides a cavity and has an opening at the end thereof spaced from the handle and lever.

A blade holder is disposed in the cavity of the nosepiece and is supported on the one end of the handle. Seated in the holder is a blade which extends outwardly of the opening in the nosepiece, and the blade has a cutting edge extending along its lower margin. A blade guard of generally U-shaped configuration extends about the cutting edge of the blade and is slidable in the nosepiece so as to extend outwardly of the opening therein and sheathe the cutting edge. It can be withdrawn into the cavity of the nosepiece to expose the cutting edge. Manipulatable means is slidably seated in the nosepiece and is engaged with the blade guard to effect its sliding movement.

Desirably, the nosepiece has spaced side walls each having a slot therein and the manipulatable means comprises buttons on the blade guard slidable in the slots. The side walls of the nosepiece have recessed portions about the slots to shield the buttons from inadvertent movement. The end of the handle has a pair of longitudinally spaced notches, and the blade guard has tabs engageable in the notches to prevent movement of the blade guard. The buttons are resiliently depressible in the slots to deflect the tabs outwardly of the notches to enable sliding movement of the blade guard. The notches correspond to the sheathed and retracted positions of the blade guard.

Preferably, the blade guard covers only a limited lower portion of the blade adjacent the cutting edge to permit facile gripping of the remainder thereof for removal of the blade from the blade holder. The blade carrier is pivotable supported on the lever, and includes a spring element bearing on the blade to retain it in the carrier. Pivoting of the lever to an open position deflects the spring element to release the blade and permit its facile removal.

Preferably, the lever and handle each have cooperating deflectable engagement elements thereon to secure the lever in a closed position against the handle.

The blade has an upper edge with a notch therein and the blade carrier has a tab engaged in the notch. One of the spring and lever has a cam portion which bears on the blade carrier during pivoting of the lever to the open position to disengage the tab from the notch. Preferably, the cam portion is a laterally projecting portion on the spring which bears upon a laterally projecting portion on the blade carrier to deflect the blade carrier.

BRIEF DESCRIPTION OF THE DRAWINGS

FIG. 27 is a side elevational view thereof;

FIG. 28 is an end elevational view of the assembly;

FIG. 29 is a bottom view thereof;

FIG. 30 is a perspective view of the blade carrier assembly and a fragmentary portion of the lever, with the illustration drawn to a reduced scale;

FIG. 31 is a perspective view of the other side of the blade carrier assembly;

FIG. 32 is a side elevational view of the blade guard with buttons thereon drawn to an enlarged scale;

FIG. 33 is a top view thereof;

FIG. 34 is a front elevational view thereof;

DETAILED DESCRIPTION OF THE ILLUSTRATED EMBODIMENTS

Turning first to FIGS. 1–6, therein illustrated is a utility knife embodying the present invention and generally comprised of a housing generally designated by the numeral 10, a cutting blade generally designated by the numeral 12 and a retractable blade guard generally designated by the numeral 14. The housing 10 is contoured for a comfortable fit in the hand of the user and is desirably fabricated using component materials which will facilitate comfortable gripping as well as provide long life.

Figure 7:
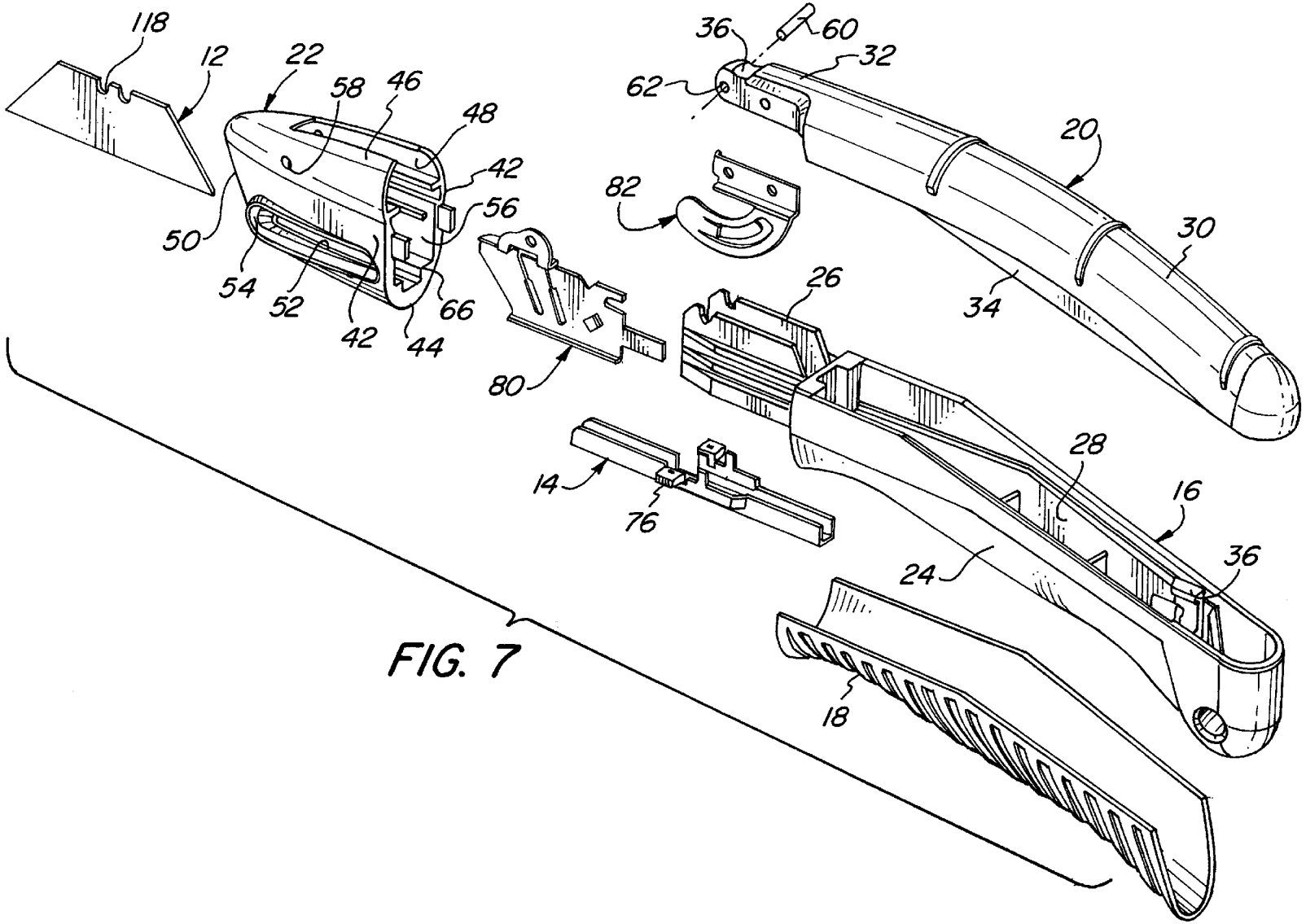
FIG. 7 is an exploded view thereof.
Figure 8:
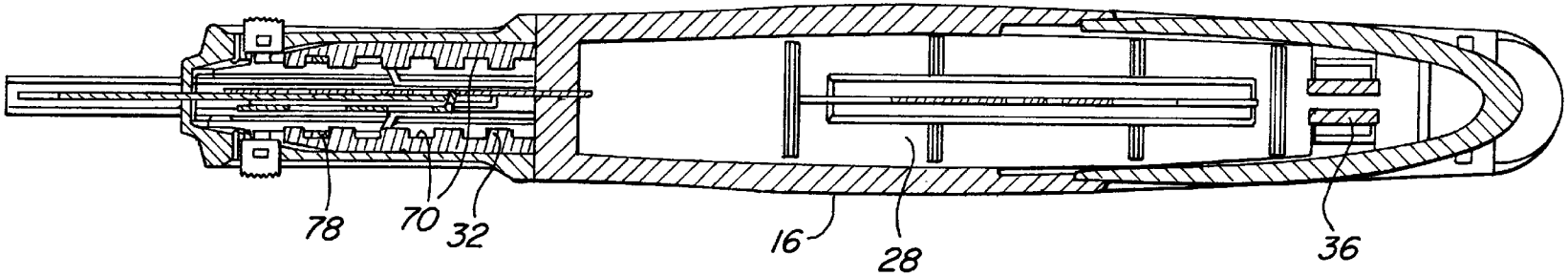
FIG. 8 is a sectional view thereof along the line 8—8 of FIG. 2.
Figure 9:
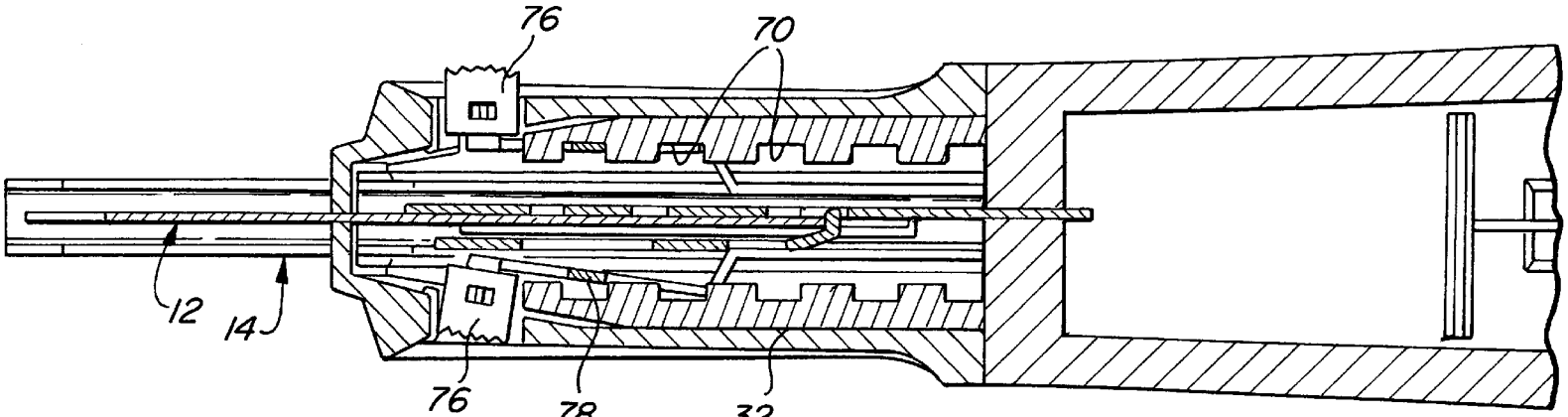
FIG. 9 is an enlarged fragmentary sectional view of the nosepiece thereof with the left hand or lower button pushed inwardly to illustrate deflection of a tab on the blade guard.
Figure 10:
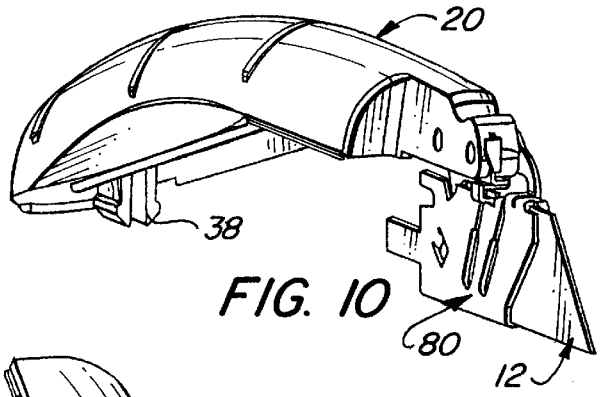
FIG. 10 is a perspective view of the lever and blade carrier drawn to a reduced scale.

As seen in FIG. 7, the housing 10 is assembled from several components of which the handle 16 is the principal one and it provides an internal cavity 28. Extending about its exterior surface is an overmolded grip 18 of a relatively resilient synthetic resin to provide a comfortable grip. The handle 16 has a bifurcated front end portion 32 and a pair of resiliently deflectable catches 36 in the cavity 28 adjacent its rear end. As best seen in FIGS. 8 and 9, the arms of the bifurcated end portion 32 have notices 70 along their opposed surfaces. Seated in the cavity 28 are spare blades 40.

The second component is the lever 20 which has an elongated handle portion 30 with a stepped portion 34 and a front end portion 32 with a transversely extending groove 35 in its upper surface. Depending from its rearward portion is a pair of resiliently deflectable catches 38 which engage with the catches 36 to latch the lever 20 to the handle 16.

The third component is the nosepiece 22 which has side walls 42, a bottom wall 44, a top wall 46 with a forwardly extending channel 48 therein and a front wall 50 with an aperture therein through which the blade 12 and blade guard 14 extend. The several walls 42, 44, 46 and 50 define a rearwardly opening cavity 56 which receives the front end portion 32 of the handle 16, and the channel 46 receives the front end portion 32 of the lever 20. The side walls 42 have elongated slots 52 therein with recesses 54 extending thereabout on the outer surface. Apertures 58 seat the pivot pin 60 which extends through the aperture 62 in the front end portion 32 of the lever 20. The groove 35 in the upper surface of the lever 20 provides clearance for the lever 20 to pivot in the channel 48.

As seen in FIGS. 7 and 21–23, the inner surfaces of the side walls 42 have ribs 66 thereon which form a channel 64 at the lower end of the cavity in which the blade guard 14 is slidably seated.

Figure 35:
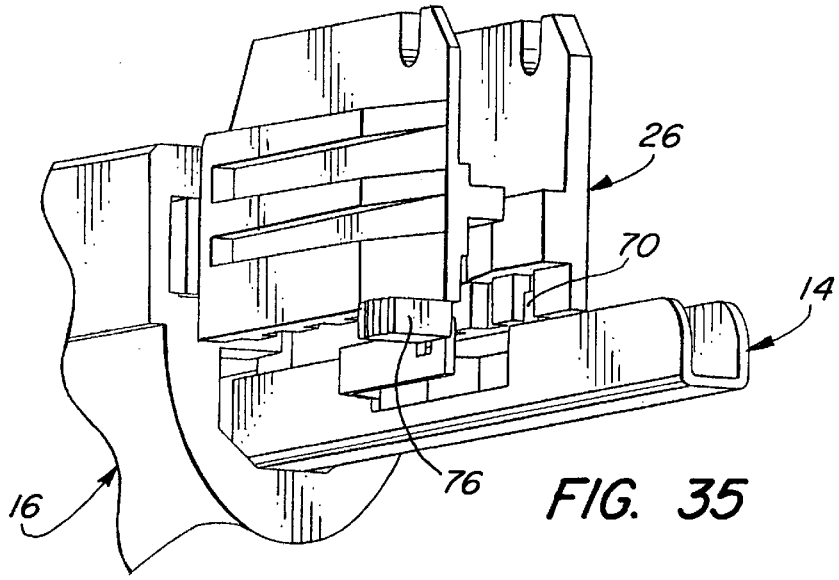
FIG. 35 is fragmentary, partially diagrammatic perspective view of the blade guard operating assembly with the blade guard tab in the first notch of the handle reflecting the sheathed position.

The blade guard 14 is illustrated in detail in FIGS. 32–34 and has a generally U-shaped configuration with a pair of laterally outwardly offset, forwardly extending arms 72 formed from its side walls intermediate the length thereof. The free end portions of the arms 72 have laterally extending fingers 74 upon which are mounted the buttons 76. Intermediate the length of the arms 72 are upstanding tabs 78 which will seat in a pair of the notches 70 in the arms 26 of the handle 16 as seen in FIGS. 35–36.

As seen in FIGS. 1–6 and 8–9, the buttons 76 are disposed in the slots 52 and are dimensioned to be disposed substantially within the recess defined by the recessed portions 54 about the slots 52 to avoid inadvertent engagement and movement of the blade guard 14.

Figure 36:
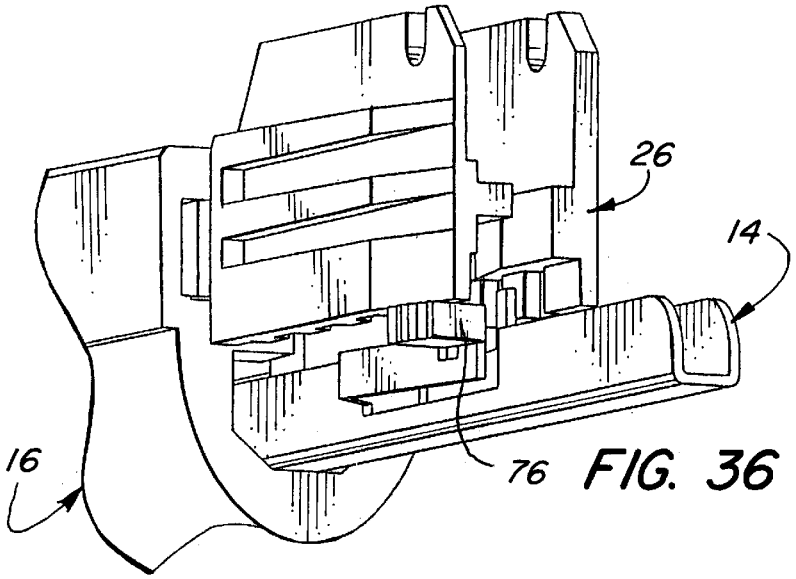
FIG. 36 is a similar view with the button depressed.
Figure 37:
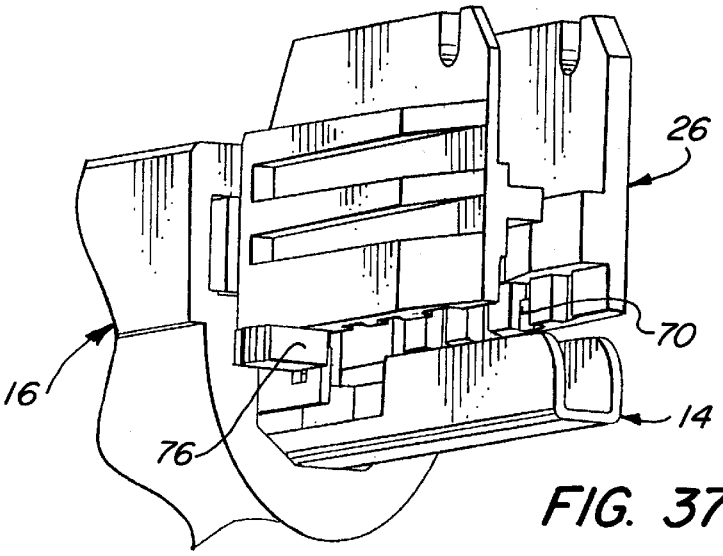
FIG. 37 is a similar view with the blade guard reflecting the retracted position.

To move the blade guard 14, the user presses inwardly on the buttons 76 which deflects the arms 72 inwardly and moves the tabs 78 outwardly of the notches 70 as illustrated by the lower button in FIG. 9 and in FIG. 36. The blade guard 14 is then moved inwardly or outwardly by pushing the tabs 78 along the slots 52.

Turning now to FIGS. 10–20, therein illustrated are the components of the blade holding assembly and the manner in which the blade 12 is securely held and readily released. The blade 12 is seated in a blade holder or carrier generally designated by the numeral 80 and is held tightly thereagainst by a spring member generally designated by the numeral 82. Both members are disposed at the front end of the lever 20 with the spring member 82 being secured thereto so as to be pivotable therewith and the blade carrier 80 remaining stationary with the handle 16 as the lever 20 pivots relative thereto.

Turning first to the blade carrier 80, it has a body portion 84, a base flange 86 upon which the blade 12 is seated and a laterally offset mounting portion 88 having an aperture 90 therein. A pair of slits in the body portion 84 provide a spring arm 92 with a tab 94 extending laterally above the base flange 86 and an offset finger 96 extending upwardly therefrom laterally spaced from the plane of the body portion 84 in the direction opposite from the flange 86. Adjacent the forward end is a laterally extending tab 98 on the top edge to restrain the blade 12 vertically. Adjacent the rear end is a tab 100 offset in the direction of the base flange 86 to provide a stop for the rear edge of the blade 12. Extending from the rear is a tailpiece 102.

The spring member 82 is formed with an arcuate body 104 with an arcuate cutout 106 forming an arcuately bent spring arm 108. The mounting portion 110 is laterally offset from the body 104 and has a laterally projecting tab 112 at its rearward end. A pair of longitudinally spaced aperatures 114 are provided in the mounting portion 110.

Figure 12:
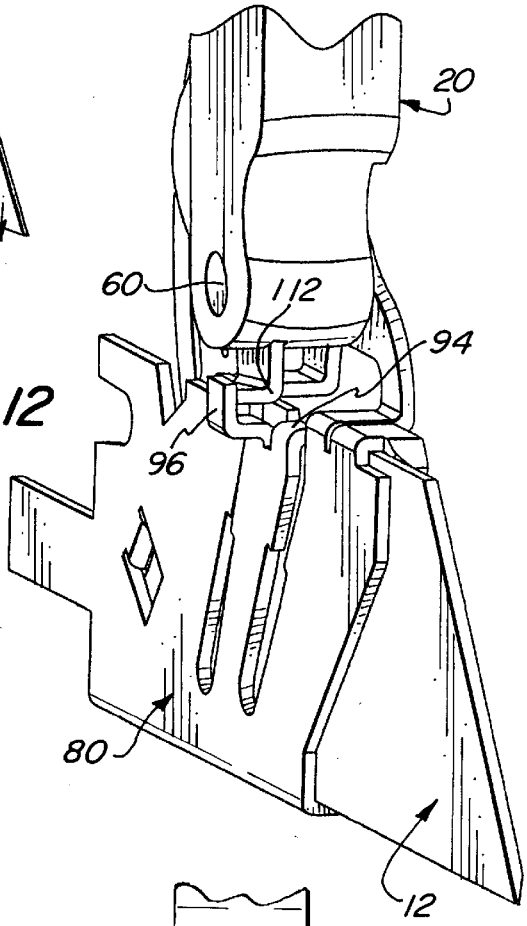
FIG. 12 is a perspective view of the front portion thereof drawn to a further enlarged scale.
Figure 20:
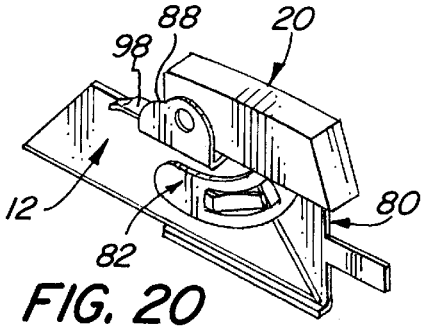
FIG. 20 is a perspective view of the blade carrier assembly comprised of the spring and holder of FIGS. 10–19, and showing a fragmentary portion of the lever, with the illustration drawn to a reduced scale.
Figure 21:
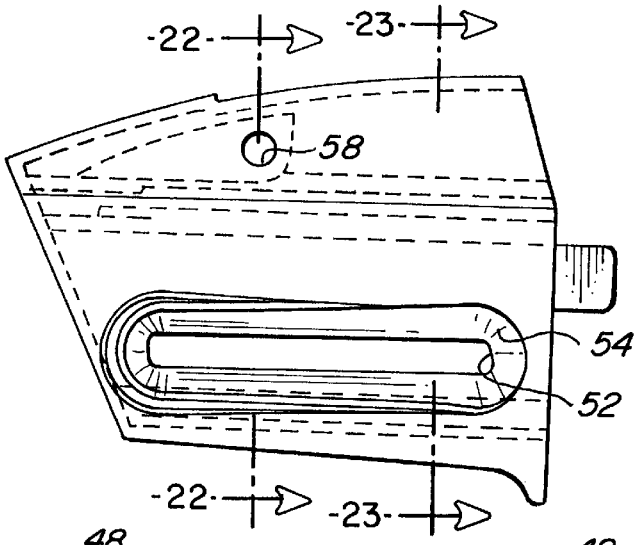
FIG. 21 is a side elevational view of the nosepiece.
Figure 23:
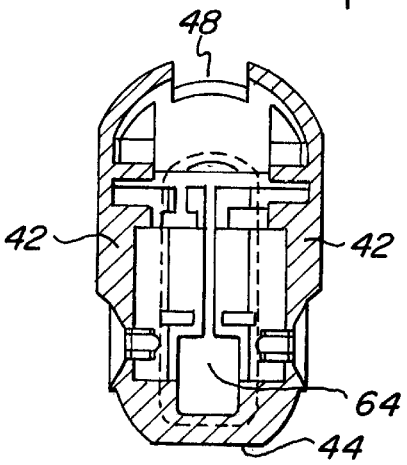
FIG. 23 is a sectional view thereof along the line 23—23 of FIG. 21.
Figure 22:
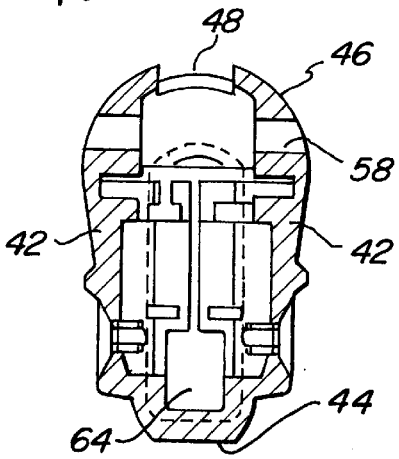
FIG. 22 is a sectional view thereof along the line 22—22 of FIG. 21.
Figure 26:
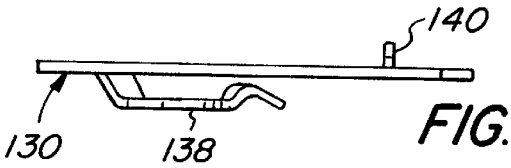
FIG. 26 is a top view thereof.
Figure 24:
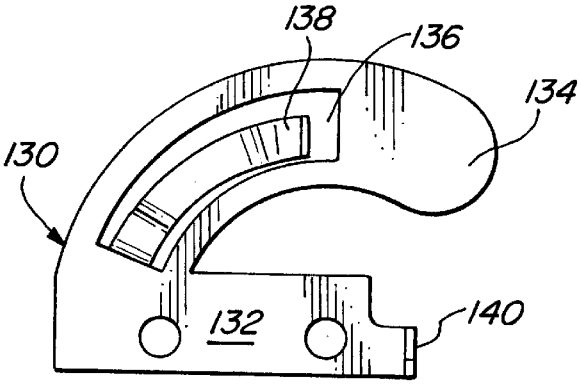
FIG. 24 is a side elevational view of an alternate embodiment of spring for the blade carrier.
Figure 25:
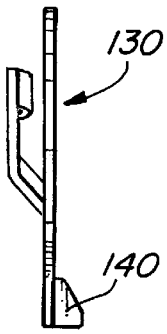
FIG. 25 is an end elevational view thereof.

The spring member 82 is fixedly mounted on the end of the lever 20 by the pivot pin 60 and the fixed pin 116 which extend through the apertures 114 of the mounting portions 110. The carrier 80 is fixedly seated in the bifurcated end 26 of the handle 16 and fixedly seats the blade 12. As best seen in FIG. 20, the body 104 of the spring member 82 extends along the surface of the blade 12 and its spring arm 108 biases the blade 12 against the body 84 of the carrier 80. The tab 98 extends above the blade 12 to provide a vertical restraint. As seen in FIG. 12, the tab 94 on the carrier 80 seats in the notch 118 of the blade 12. As a result, the blade 12 is firmly positioned in the handle assembly 10.

Figure 1:
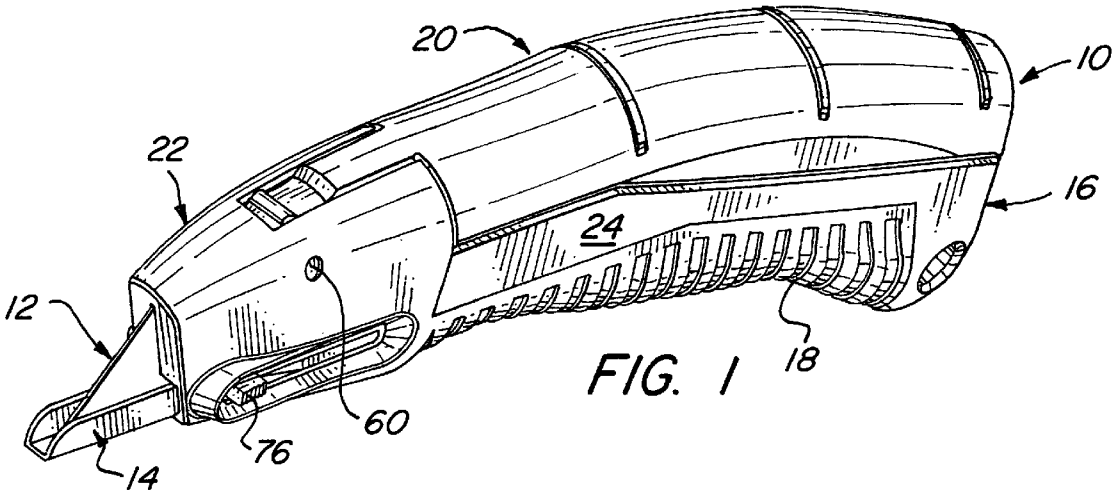
FIG. 1 is a perspective view of a utility knife embodying the present invention with the blade guard extended.
Figure 2:
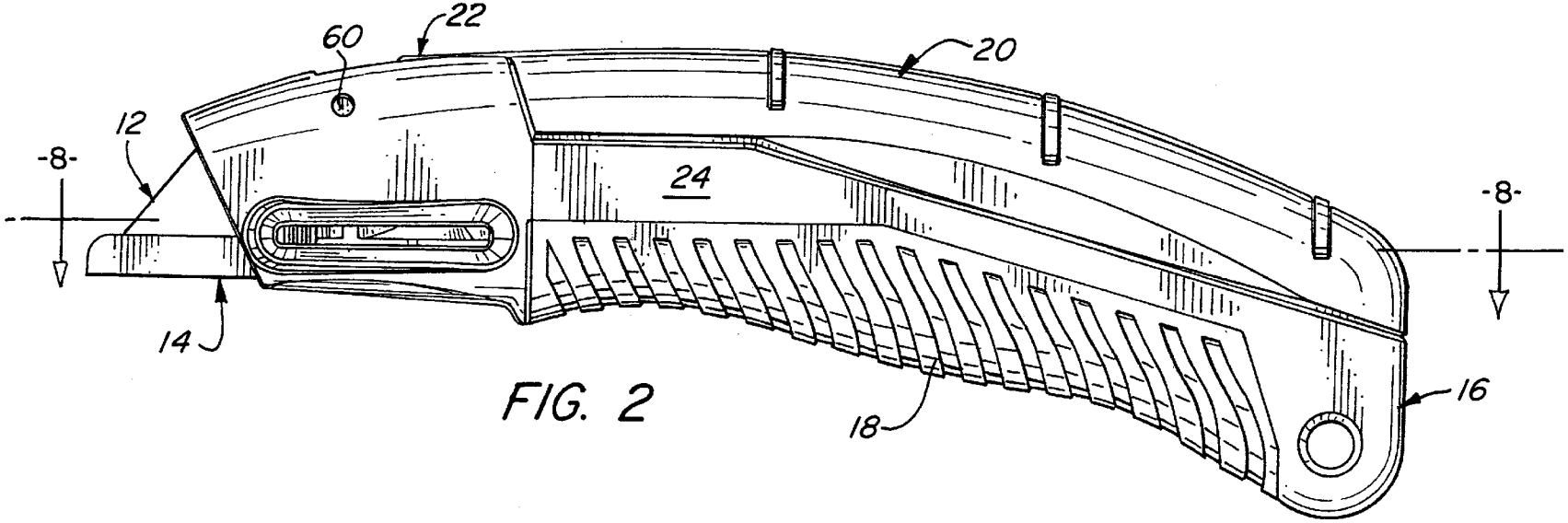
FIG. 2 is a side elevational view thereof drawn to an enlarged scale.
Figure 3:
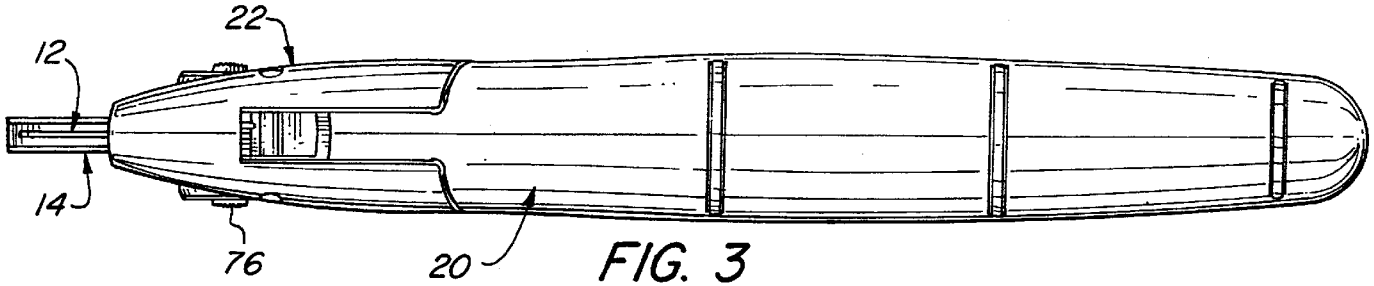
FIG. 3 is a top view thereof.
Figure 4:
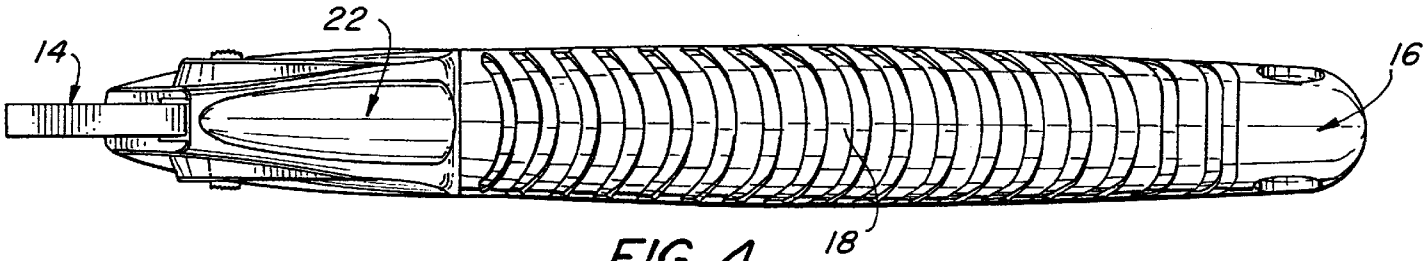
FIG. 4 is a bottom view thereof.
Figure 6:
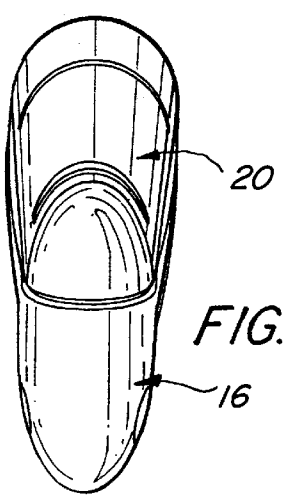
FIG. 6 is a rear elevational view thereof.
Figure 5:
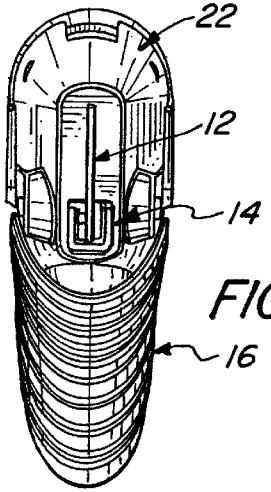
FIG. 5 is a front elevational view thereof.
Figure 11:
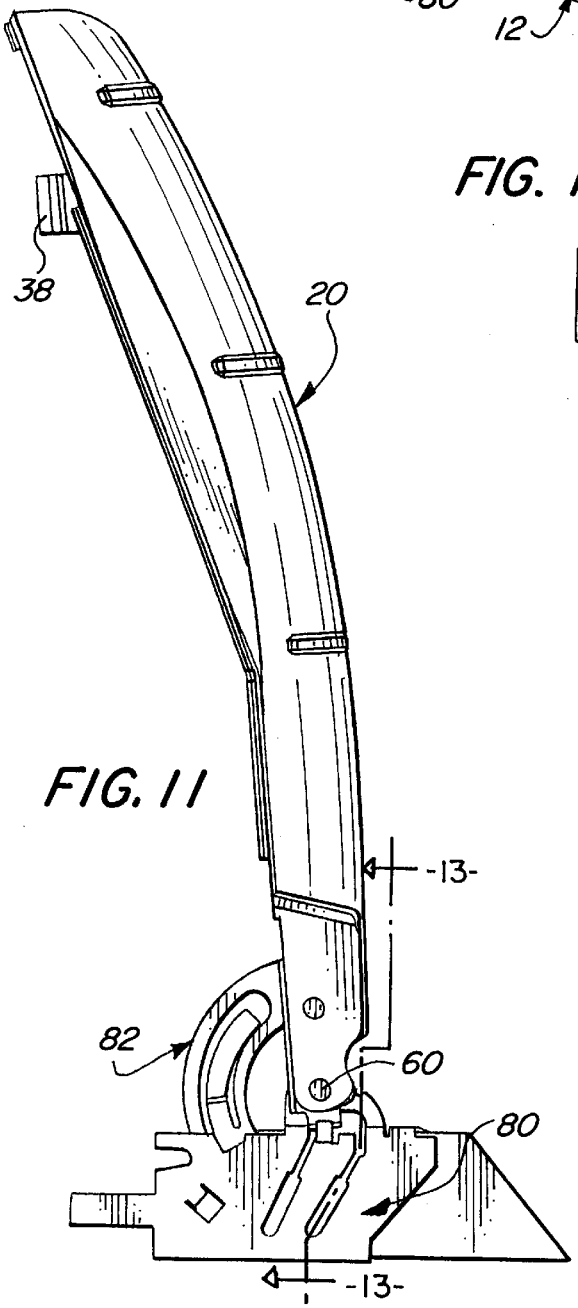
FIG. 11 is a side elevational view thereof drawn to an enlarged scale and with the blade carrier pivoted 90 degrees relative to the lever from the position shown in FIG. 10.
Figure 13:
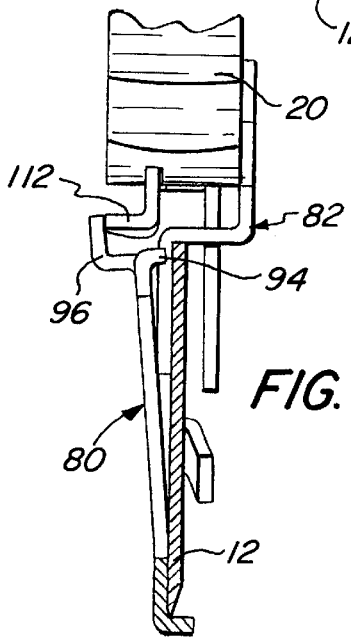
FIG. 13 is a sectional view thereof along the line 13—13 of FIG. 11.
Figure 16:
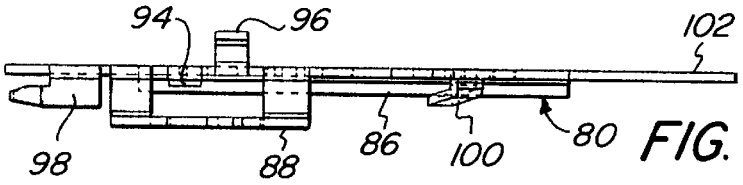
FIG. 16 is a top view thereof.
Figure 14:
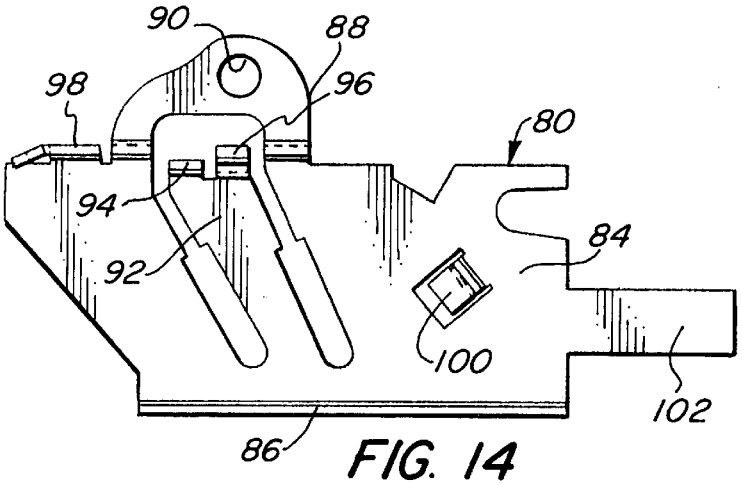
FIG. 14 is a side elevational view of the blade carrier.
Figure 15:
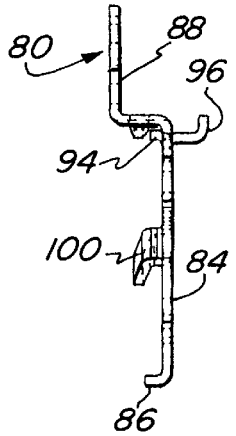
FIG. 15 is an end elevational view thereof.
Figure 17:
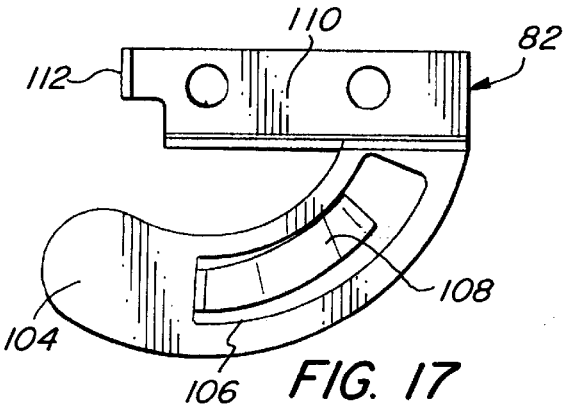
FIG. 17 is a side elevational view of the spring utilized with the blade holder of FIGS. 10–16.
Figure 18:
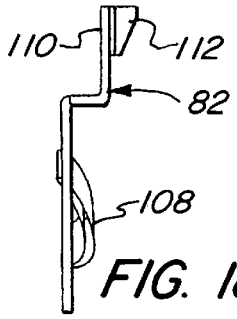
FIG. 18 is an end elevational view thereof.
Figure 19:
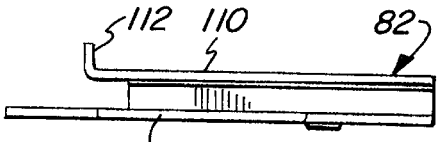
FIG. 19 is a top view thereof.

When it is desired to change the blade 12, the lever 20 is disengaged from the fingers 36 of the handle 16 and pivoted from the position seen in FIG. 1 to a position in which it is perpendicular to the longitudinal axis of the nosepiece 22 and blade 12 as shown in FIGS. 11–13. As the lever 20 is pivoted, the tab 112 bears against the finger 96 to deflect the upper portion of the carrier 80 and move the tab 94 outwardly of the notch 118 of the blade 12 as seen in FIG. 13. As a result, the blade 12 can be easily slid outwardly of the carrier 80.

A new blade 12 can then be inserted while the lever 20 is in this pivoted position, and it will be locked in place when the lever 20 is pivoted to its closed position.

Turning now to FIGS. 24–31, therein illustrated is another embodiment of a spring which may be used. In this embodiment, the spring generally designated by the numeral 130 has its mounting portion 132 and body 134 lying in the same plane, and it is provided with an arcuate slit 136 which generates a spring arm 138 which is laterally offset from a point which is above the blade 12 seated in the carrier 80. As seen in FIGS. 30 and 31, the spring arm 138 is disposed against the surface of the blade 12 and the body 134 is disposed on the opposite side of the carrier 80 to firmly clamp the blade 14. The tab 140 on the spring 130 functions similarly to deflect the carrier 80 upon pivoting of the lever 20.

Thus, it can be seen from the foregoing description that the utility knife of the present invention enables facile release of the blade from its carrier merely by pivoting the lever from its closed position to its open position which disengages the tab from the notch in the blade. The blade may then be slid outwardly of the carrier through the front of the nosepiece. However, during normal operation, the blade is firmly held in position within the carrier by the spring.

Moreover, since the blade guard covers only a limited portion of the bottom of the blade, the whole surface of the blade thereabove is exposed for gripping by the user to remove or to insert the blade into the carrier.

By placing the manipulating buttons for the blade guard in a recessed area of the nosepiece, they are essentially free from inadvertent manipulation as the blade is being transported in the pocket of the user or in a toolbox since the buttons must be physically pushed inwardly of the recess in order to effect the release of the tabs on the guard from the notches in which they are firmly secured.

The components of the assembly may be simply fabricated. Ideally, the nosepiece is a die casting of zinc or aluminum or other suitable metal so as to enable facile formation with all of its contours. The handle and the lever are readily formed from synthetic resins by conventional molding operations. Glass reinforced polypropylene and other similar resins are desirable for this application to provide high strength and durability. For comfort, a relatively soft synthetic resin is employed for the grip, and the grip is conveniently overmolded onto the body of the handle. However, it may be separately molded and secured thereto by adhesive, sonic welding or the like. Polyolefin elastomers are desirably employed for this application since they can be bonded readily to polypropylene which is conveniently employed. The carrier and the spring are easily fabricated by stamping sheet metal. Thus, the whole structure is readily assembled from a small number of component parts which can be economically fabricated.

Thus, it can be seen from the foregoing detailed description and attached drawings that the utility knife of the present invention is one which can be readily and relatively economically fabricated, and which can be fabricated of materials which provide long life. The blade guard is easily manipulated, but is essentially free from inadvertent dislodgement from its blade protecting position. The blade is securely held in position but it can be readily released from its engagement by simply pivoting the lever to its open position to release the blade from the holder and then sliding blade outwardly therefrom.

Having thus described the invention, what is claimed is:

1. A fixed blade utility knife comprising:

(a) a housing providing an internal cavity and including a handle providing the lower portion thereof, a lever providing the upper portion thereof, and a nosepiece at one end thereof seating one end of said handle and said lever, said lever having said one end thereof pivotably supported on said nosepiece for pivotal movement relative to said handle between a closed position abutting said handle and an open position extending substantially perpendicularly to the longitudinal axis of said nosepiece, said nosepiece providing a cavity and having an opening at the end thereof spaced from said handle and lever;

(b) a blade holder in said cavity of said nosepiece supported on said one end of said handle;

(c) a blade seated in said holder and extending outwardly of said opening in said nosepiece, said blade having a cutting edge extending along its lower margin;

(d) engaging means for securing said blade in said holder, said lever being operable to release said blade engaging means upon pivoting thereof to said open position;

(e) a blade guard of generally U-shaped cross section extending about said cutting edge and over only the lower portion of said blade to permit facile gripping of the remainder thereof for removal of said blade from said blade holder, said blade guard being slidable in said nosepiece so as to extend outwardly of said opening and sheathe said cutting edge and to be withdrawn into said cavity of said nosepiece to expose said cutting edge; and (f) manipulatable means slidably seated in said nosepiece and engaged with said blade guard to effect sliding movement of said blade guard.

2. The fixed blade utility knife in accordance with claim 1 wherein said nosepiece has spaced side walls each having a slot therein and said manipulatable means comprises buttons on said blade guard slidable in said slots.

3. The fixed blade utility knife in accordance with claim 2 wherein said side walls of said nosepiece have recessed portions about said slots to shield said buttons from inadvertent movement.

4. The fixed blade utility knife in accordance with claim 2 wherein said one end of said handle has a pair of longitudinally spaced notches and wherein said blade guard has tabs engageable in said notches to prevent movement of said blade guard, said buttons being resiliently depressible in said slots to deflect said tabs outwardly of said notches to enable sliding movement of said blade guard, said notches corresponding to the sheathed and retracted positions of said blade guard.

5. The fixed blade utility knife in accordance with claim 1 wherein said blade holder is pivotably supported on said lever.

6. The fixed blade utility knife in accordance with claim 5 wherein said blade holder includes a spring element bearing on said blade to bias it against said holder and wherein pivoting of said lever to an open position releases the biasing force of said spring element and said blade engaging means to permit facile removal of said blade from said holder.

7. The fixed blade utility knife in accordance with claim 6 wherein said blade has an upper edge with a notch therein and wherein said blade holder has a tab engaged in said notch to provide said engaging means, one of said lever and spring having a cam portion which bears on said blade holder during pivoting of said lever to said open position to disengage said tab from said notch.

8. The fixed blade utility knife in accordance with claim 7 wherein said cam portion is a laterally projecting portion on said spring which bears upon a laterally projecting portion on said portion of said blade holder to deflect said blade holder.

9. The fixed blade utility knife in accordance with claim 1 wherein said lever and handle each have cooperating engagement elements thereon to secure said lever in a closed position against said handle.

10. A fixed blade utility knife comprising:

(a) A housing providing an internal cavity and including a handle providing the lower portion thereof, a lever providing the upper portion thereof, and a nosepiece at one end thereof seating one end of said handle and said lever, said lever having said one end thereof pivotably supported on said nosepiece for pivotal movement relative to said handle between a closed position abutting said handle and an open position extending substantially perpendicularly to the longitudinal axis of said nosepiece, said nosepiece providing a cavity and having an opening at the end thereof spaced from said handle and lever;

(b) a blade holder in said cavity of said nosepiece supported on said one end of said handle, said nosepiece having spaced side walls each having a slot therein, said lever and handle each having cooperating engagement elements thereon to latch said lever in a closed position against said handle;

(c) a blade seated in said holder and extending outwardly of said opening in said nosepiece, said blade having a cutting edge extending along its lower margin, said blade being secured in said holder by engaging means, said engaging means being releasable upon pivoting of said lever to said open position;

(d) a blade guard of generally U-shaped configuration extending about said cutting edge, said blade guard being slidable in said nosepiece so as to extend outwardly of said opening and sheathe said cutting edge and to be withdrawn into said cavity of said nosepiece to expose said cutting edge, said blade guard covering only a imitated lower portion of said blade adjacent said cutting edge to permit facile gripping of the remainder thereof for removal of said blade from said blade holder; and (e) manipulable means slidably seated in said nosepiece and engaged with said blade guard to effect sliding movement of said blade guard, said manipulatable means comprising buttons on said blade guard slidable in said slots.

11. The fixed blade utility knife in accordance with claim 10 wherein said side walls of said nosepiece have recessed portions about said slots to shield said buttons from inadvertent movement.

12. The fixed blade utility knife in accordance with claim 11 wherein said one end of said handle has a pair of longitudinally spaced notches and wherein said blade guard has tabs engageable in said notches to prevent movement of said blade guard, said buttons being resiliently depressible in said slots to deflect said tabs outwardly of said notches to enable sliding movement of said blade guard, said notches corresponding to the sheathed and retracted positions of said blade guard.

13. The fixed blade utility knife in accordance with claim 10 wherein said blade holder is pivotably supported on said lever.

14. The fixed blade utility knife in accordance with claim 13 herein said blade holder includes a spring element bearing on said blade to retain it in said holder and wherein pivoting of said lever to an open position deflects said spring element to release said blade and permit facile removal of said blade from said holder.

15. The fixed blade utility knife in accordance with claim 14 wherein said blade has an upper edge with a notch therein and wherein said blade holder has a tab engaged in said notch to retain said blade in said holder, one of said lever and spring having a cam portion which bears on said blade holder during pivoting of said lever to said open position to disengage said tab from said notch.

16. The fixed blade utility knife in accordance with claim 15 wherein said cam portion is a laterally projecting portion on said spring which bears upon a laterally projecting portion on said portion of said blade holder to deflect said blade holder.

* * * * *